US005893641A

United States Patent [19]

Garcia

[11] Patent Number: 5,893,641

[45] Date of Patent: Apr. 13, 1999

[54] DIFFERENTIAL INJECTOR

[76] Inventor: Paul Garcia, P.O. Box 18000-163, Las Vegas, Nev. 89109

[21] Appl. No.: 09/083,922

[22] Filed: May 26, 1998

[51] Int. Cl.[6] ..... B01F 5/04

[52] U.S. Cl. ..... 366/163.2; 137/888

[58] Field of Search ..... 366/162.1, 163.1, 366/163.2, 167.1, 173.1, 173.2; 137/888, 889, 890, 896

[56] References Cited

U.S. PATENT DOCUMENTS

| | | | |
|---|---|---|---|
| 398,456 | 2/1889 | Secor . | |
| 2,361,150 | 10/1944 | Petroe . | |
| 2,424,654 | 7/1947 | Gamble . | |
| 2,563,002 | 8/1951 | Bissell et al. | 366/163.2 |
| 3,257,180 | 6/1966 | King . | |
| 3,502,103 | 3/1970 | Verschuur | 137/896 |
| 3,507,626 | 4/1970 | Horn . | |
| 3,768,962 | 10/1973 | Baranowski, Jr. . | |
| 3,826,279 | 7/1974 | Verschuur | 137/896 |
| 3,993,097 | 11/1976 | Verschuur | 137/896 |
| 4,123,800 | 10/1978 | Mazzei . | |
| 4,333,833 | 6/1982 | Longley et al. . | |
| 4,344,752 | 8/1982 | Gallagher, Jr. | 366/163.2 |
| 4,761,077 | 8/1988 | Werner | 137/896 |
| 4,765,373 | 8/1988 | Munroe . | |
| 5,452,955 | 9/1995 | Lundstrom | 366/163.2 |
| 5,693,226 | 12/1997 | Kool . | |
| 5,758,691 | 6/1998 | Nedderman, Jr. | 137/896 |

FOREIGN PATENT DOCUMENTS

| | | |
|---|---|---|
| 20339 | 9/1956 | Australia . |
| 802691 | 10/1958 | United Kingdom . |
| 870525 | 6/1961 | United Kingdom . |
| 1320746 | 6/1973 | United Kingdom . |

*Primary Examiner*—Charles E. Cooley
*Attorney, Agent, or Firm*—Richard C. Litman

[57] ABSTRACT

A venturi driven differential injector for fluid mixing having a constricting primary fluid inlet, a throat section and a diverging discharge outlet. A secondary fluid is pulled into the forward portion of the discharge outlet, through at least two annular recessed grooves, by suction action produced by the primary fluid of the venturi. A plurality of channels feed the secondary fluid into the recessed annular grooves. The venturi ports are connected to a secondary fluid injection port via an injection annulus.

6 Claims, 3 Drawing Sheets

DIFFERENTIAL INJECTOR

BACKGROUND OF THE INVENTION

1. Field of the Invention

The present invention relates generally to a fluid mixing apparatus. More specifically, the invention is a venturi driven fluid mixing device.

2. Description of the Related Art

A variety of fluid mixing devices have been devised wherein a venturi is adapted with different types of mechanical injectors. Fluid flow through pipes and other flow devices have associated losses inherent to the device, depending on the type of material the flow channel or device is composed of, and the manufacturing method used to produce the fluid flow device. Also, depending on the physical features of the channels (i.e. surface texture, roughness, etc.) or the surfaces on which a fluid traverses, head losses in the flow results.

These losses within a flow device such as a venturi driven flow system vary from device to device, depending on the mechanical element adapted thereto. For example, losses associated with mechanical elements such as check valves, mechanical injectors, blowers, compressors, pumps, etc. during the injection of liquid, air or other elements within the primary flow of liquids through the flow device serve to minimize fluid flow the pressure differential.

Generally, the principal goal for maintaining fluid flow within a network of interconnected flow channels or elements, according to first principles in mechanics of fluids, is to minimize total head losses associated with the respective mechanical elements. Most of the conventional fluid flow devices have failed to reduce the total head losses as herein described by the instant invention. Without significantly reducing the head losses associated with the mechanical elements as recited above, a significant drop in the volume flow rate or pressure occurs within most flow devices. This directly affects the mixing of multiple fluids within the primary fluid channel or stream of typical fluid flow devices.

For example, U.S. Pat. No. 2,361,150 issued Petroe discloses a method and apparatus for admitting chlorine to a stream of pulp stock via a plurality of injectors or nozzles during the effluent stage. The mechanical injectors are peripherally disposed within the flow stream or path having a direct contribution to the total head loss unlike the differential injector as herein described.

U.S. Pat. No. 2,424,654 issued to Gamble discloses a fluid mixing device which also suffers from head losses as recited above. A venturi flow device having an adjustable throat section includes baffles disposed directly in the flow path or throat (i.e. in-line injectors) of the device which contributes to the total head loss as similarly taught by the patent of Gamble. Other varieties of in-line injectors are those taught by King (U.S. Pat. No. 3,257,180), Van Horn (U.S. Pat. No. 3,507,626), Baranowski, Jr. (U.S. Pat. No. 3,768,962) and Longley et al. (U.S. Pat. No. 4,333,833).

U.S. Patents issued to Secor (U.S. Pat. No. 398,456) and Mazzei (U.S. Pat. No. 4,123,800) disclose a venturi flow device comprising a mixer injector disposed at the throat section of the device. The patent of Mazzei in particular comprises a plurality of port means which are angularly spaced-apart around the throat section and interconnect an annular chamber disposed within an inside wall of the throat portion. This particular design is similar to that of the instant invention in that, it attempts to minimize a pressure drop within the channel. The injector of Mazzei, however, fails to reduce losses at the throat section unlike that of the instant invention as herein described.

U.S. Pat. No. 5,693,226 issued to Kool discloses an apparatus for demonstrating a residential point of use water treatment system wherein an injection port or suction branch injects a contaminate material in a direction perpendicular to the flow stream via hoses adapted thereto. The differential injector according to the instant invention is different in that the injections are made in a direction parallel to the flow stream which significantly reduces head losses attributed to the differential injector as herein described.

U.S. and Foreign Patents by Monroe (U.S. Pat. No. 4,765,373), Luft et al. (AU 203339), Gretton-Lowe (GB 802,691), Hollins (GB 870,525) and Evans (GB 132074) disclose flow devices generally relevant to that of the instant invention.

The difference between the instant invention and the related art is that the differential injector according to the instant invention provides a means for mixing without the additional need of mechanical injectors which increase the number of head losses in the primary flow stream. Mixing occurs by injection parallel to the flow stream with virtually zero losses compared to conventional flow devices.

In this regard, none of the above inventions and patents, taken either singularly or in combination, is seen to describe the instant invention as claimed. Thus a differential injector solving the aforementioned problems is desired.

SUMMARY OF THE INVENTION

The differential injector according to the instant invention is a venturi driven fluid mixing device having a constricting primary fluid inlet, a throat section and a diverging discharge outlet. A secondary fluid is pulled into the forward portion of the discharge outlet, through at least two annular recessed grooves, by suction action produce by the primary fluid of the venturi. A plurality of venturi ports feeds the secondary fluid into the recessed annular grooves. The venturi ports are connected to a secondary fluid injection port via an injection annulus.

Accordingly, it is a principal object of the invention to provide a differential injector for reducing total head loss in a flow device by injection.

It is another object of the invention to provide a differential injector which mixes fluids with a minimum number of attached mechanical elements.

It is a further object of the invention to provide a differential injector which easily assembled and disassembled for inspection.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a differential injector which produces mixing in a flow device with virtually zero losses by injection. The preferred embodiments of the present invention are depicted in FIGS. 3–5, and are generally referenced by numeral 20.

The aim according to the instant invention is to produce fluid injections of one or more fluid elements within a venturi driven flow device having virtually zero losses via the method of injection. The differential injector according to the instant invention is applicable to various applications such as an aeration device for water and sewer treatment plants, pools, jacuzzies, a mixing device for paints, chemicals or injectors for dyes and chemicals, etc., solid sewage shredder, agitation device for water treatment plants and oil separation plants, etc.

Figure 1:
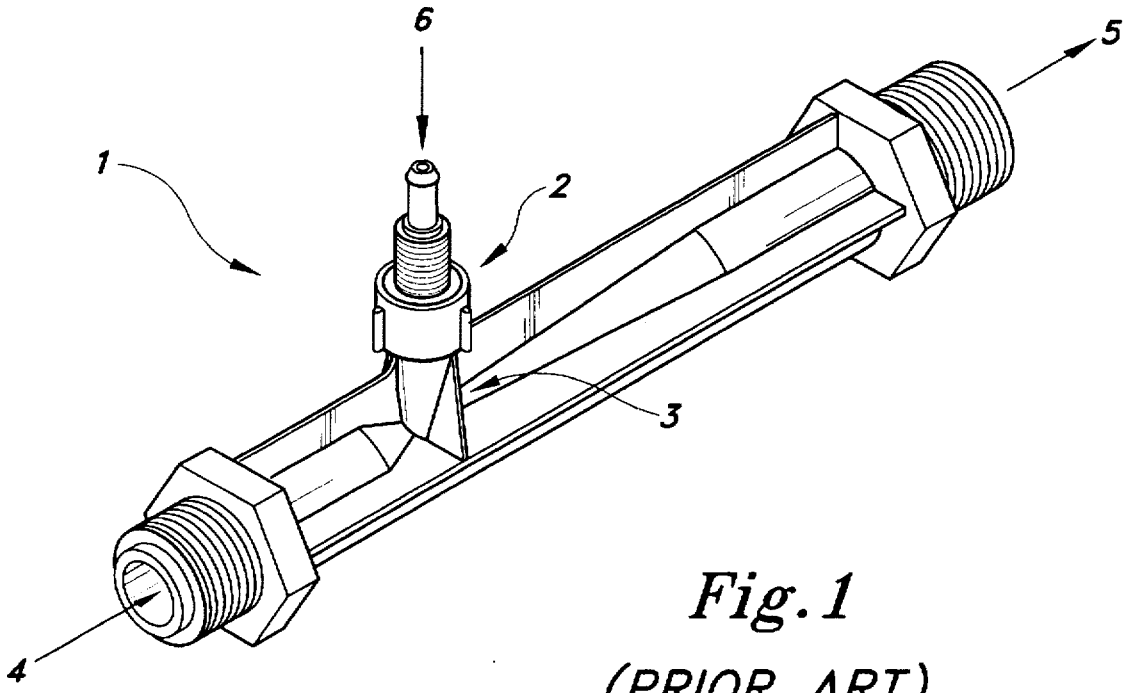
Fig. 1 (PRIOR ART)
FIG. 1 is a perspective view of a prior art, conventional venturi flow device.
Figure 2:
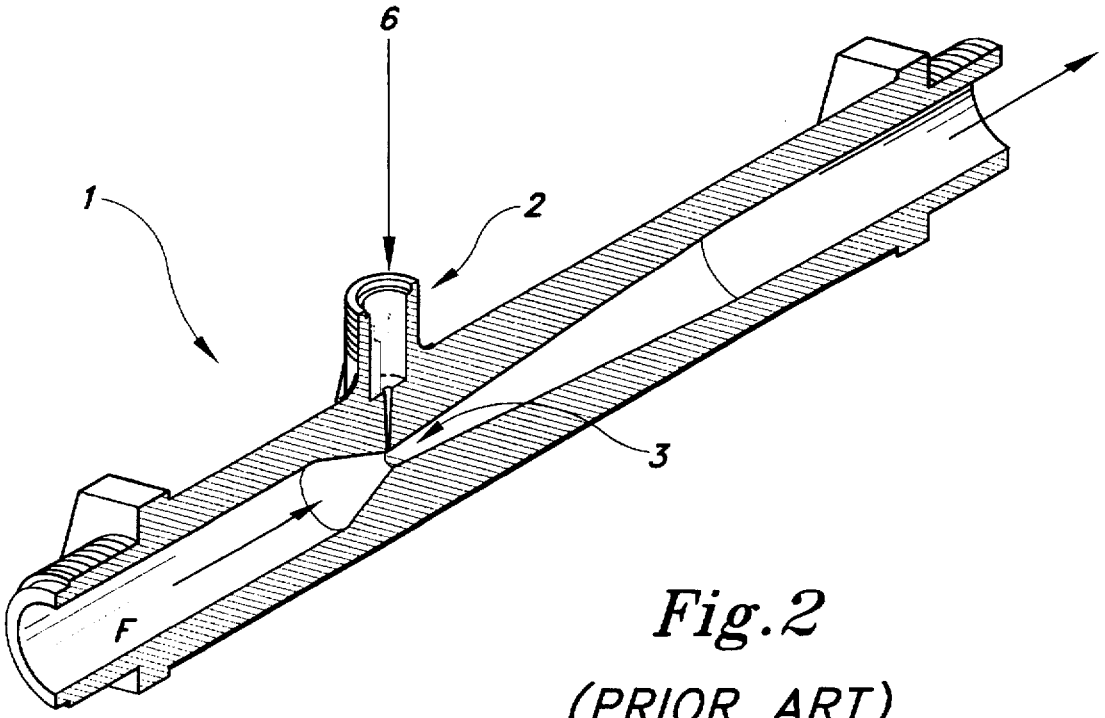
Fig. 2 (PRIOR ART)
FIG. 2 is a cross-sectional perspective view of the prior art, conventional venturi flow device in FIG. 1.

Conventional flow devices provides mixing via a flow device as diagrammatically illustrated in FIGS. 1 and 2. As seen in these figures, a venturi driven flow device 1 has a fluid injection means 2 disposed at the throat 3 of the venturi 1. A fluid flow entrance (influent) 4 and exit (effluent) 5 provide the primary flow path F for the device 1. A secondary fluid flow path 6 is provided by the injector 2. The secondary fluid flow 6 is injected directly into the primary flow stream in a direction perpendicular thereto. This type of injection introduces a pressure differential (or associated loss) within the flow stream which decreases the degree of uniform mixing between the primary and secondary fluid in the conventional flow device.

Figure 3:
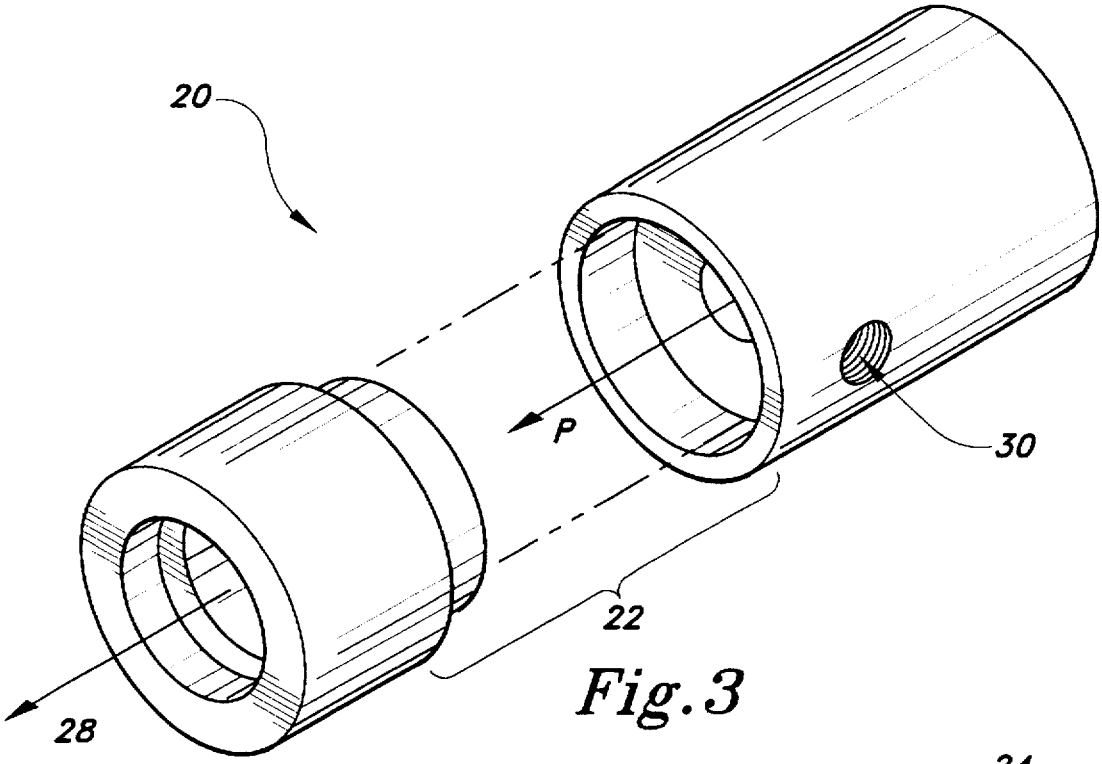
FIG. 3. is an exploded perspective view of the differential injector according to the present invention.
Figure 4:
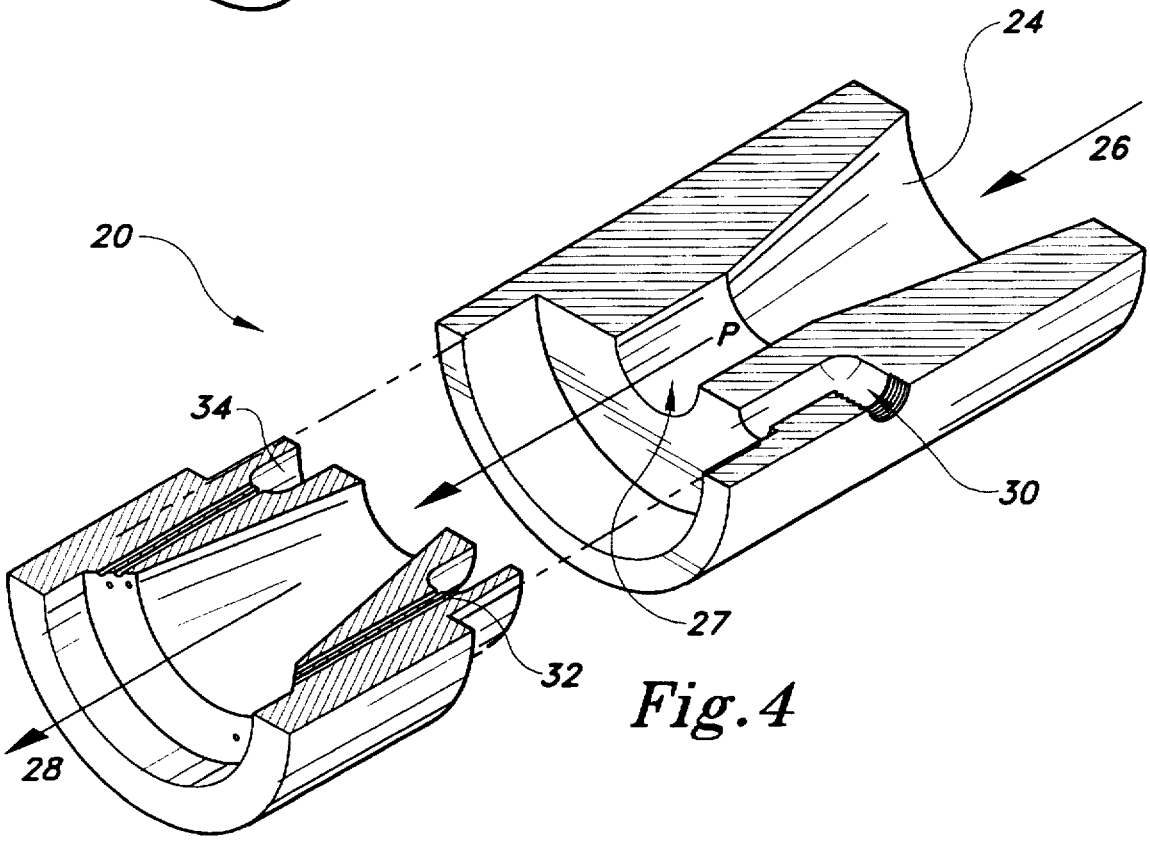
FIG. 4 is an exploded cross-sectional view of the differential injector according to FIG. 3, illustrating a plurality of injection channels for injecting fluid within the flow device for mixing.
Figure 5:
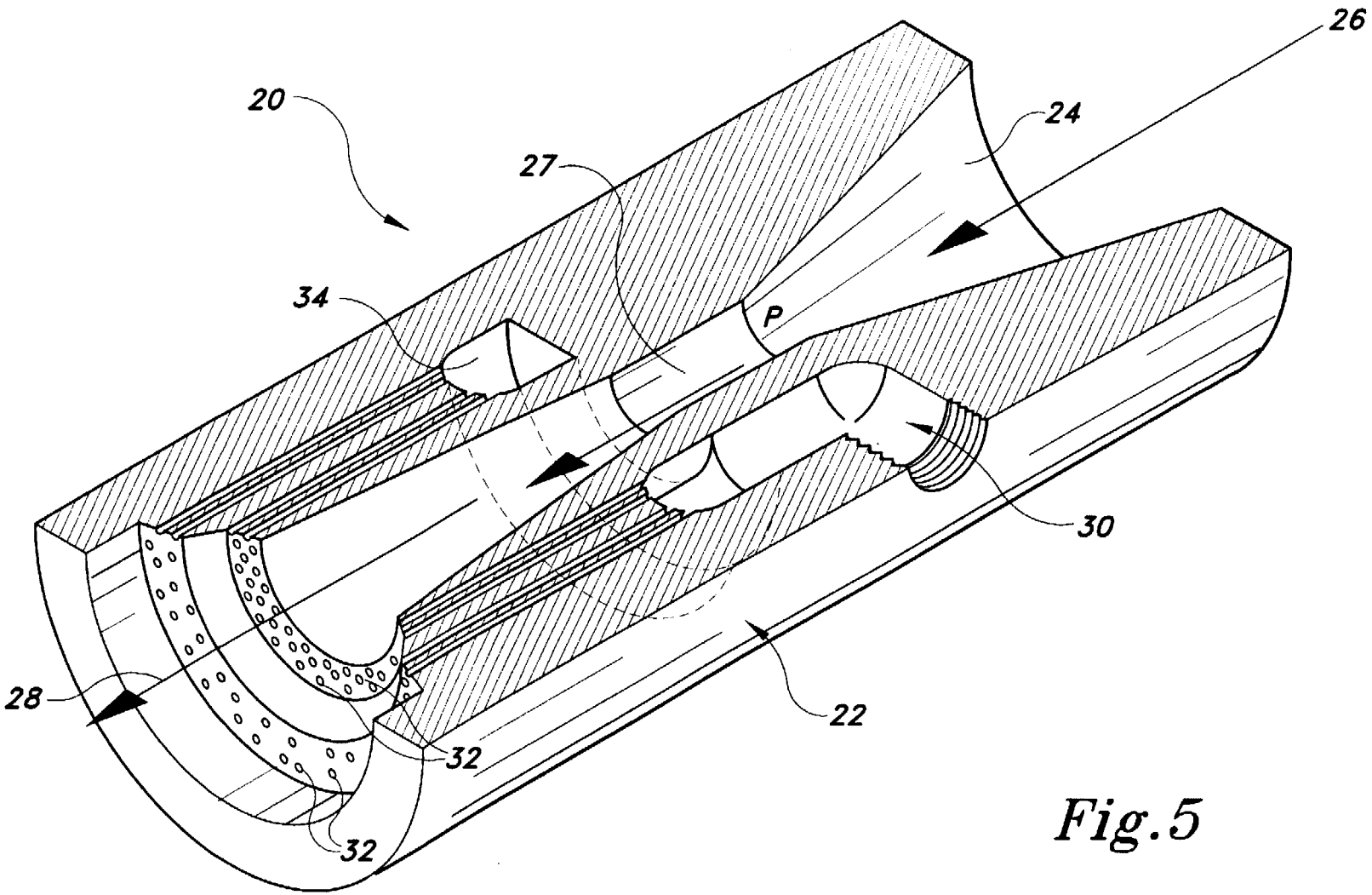
FIG. 5 is a cross-sectional view of the differential injector of the invention according to an alternate embodiment, illustrating a plurality of channels coupled by a annular cavity for injecting fluid within the flow device for mixing.

As best seen in FIGS. 3 and 4, the differential injector 20 according to the preferred embodiment comprises a substantially cylindrical fluid flow body 22 having a venturi 24 disposed therein. The venturi 24 is disposed and aligned concentric with the body 22 for providing primary fluid flow P through the venturi 24. The venturi 24 has an inlet port 26 or the influent portion of the primary flow and an outlet port 28. The inlet port converges at a throat section of the venturi 24 and diverges at the outlet port 28 or effluent portion of the primary flow. A primary fluid such as water enters the differential injector 20 for mixing. Depending upon the area of application a secondary fluid comprising various chemicals or fluids as recited above are adapted to the injector 20 for mixing without injection directly within the throat 27 of the venturi 24. It would be obvious to the skilled artisan to provide the appropriate adaptor for injecting fluids as a matter of intended use.

Accordingly, a secondary fluid or injector port 30 is provided for supplying a plurality of fluids for mixing with the primary fluid P. The injector port 30, as diagrammatically illustrated in FIG. 3 is disposed within a first wall portion of the substantially cylindrical fluid flow body 22. A cross-sectional view of FIG. 3, as shown in FIG. 4, further illustrates the arrangement of a plurality of channels 32 disposed within a second wall portion of the body 22 for delivering a secondary fluid downstream from the throat 27, of the venturi 24, to the effluent portion of the primary fluid flow P. The channels 32 as shown in FIG. 4 are disposed within the body 22 in parallel arrangement with respect to the venturi 24. This arrangement is significant in that the secondary fluid is injected with zero resistance with respect to the primary flow direction. This point of injection translates into reduced head loss within the differential injector 20.

According to an alternate embodiment as diagrammatically illustrated in FIG. 5, the differential injector 20 is shown as a single unit further comprising an annular cavity 34 in fluid communication with the injector port 30 and a plurality of channels 32 peripherally arranged and concentric with the venturi 24, for improving the secondary to primary fluid mixing ratio by volume.

Other advantages of the differential injector 20 according to the preferred embodiment are that it is made of a composite plastic material which is easily machined to the desired dimensions. Also, this material can be easily removed in multiple parts as illustrated in FIGS. 3 and 4 for inspection and or replacement while in actual use. Other non-obvious advantages of the differential injector 20 were achieved through the design by reducing the inlet flow rate by ½ the diameter of the body 22 and holding that size for a distance of 2.5 times its diameter. At this point the effluent discharge is opened to a length equal to ½ the distance of the inlet or influent side, thus causing a huge build-up of pressure with an instant release at the discharge end. In the discharge side two annular (Recessed Annular injection Design (RAID) grooves causing the discharged liquid to surge over these grooves and in doing so, create a tremendous suction action in these (RAID) grooves. By connecting these (RAID) grooves to an injection port through an injection annulus that has the volume capacity equal to several times the capacity that of the venturi ports can carry.

It is to be understood that the present invention is not limited to the embodiments described above, but encompasses any and all embodiments within the scope of the following claims.

I claim:

1. A differential injector for mixing in a flow device comprising:

a substantially cylindrical fluid flow body having a venturi disposed therein and first and second wall portions therein, said venturi being disposed and aligned concentrically with said cylinder, for providing primary fluid flow through said venturi, the venturi having an inlet port and an outlet port;

a secondary fluid port for supplying a plurality of fluids for mixing with the primary fluid, said secondary port being disposed within said first wall portion of the substantially cylindrical fluid flow body, for delivering secondary fluid to a plurality of flow channels, said channels being disposed within said second wall portion of the substantially cylindrical fluid flow body, and disposed in parallel arrangement with respect to the venturi, for providing secondary fluid along and parallel to an effluent portion of the primary fluid flow by injection.

2. A differential injector for mixing in a flow device according to claim 1, wherein said substantially cylindrical flow body further comprises means defining an annular cavity disposed within a central portion of said flow device and concentric thereto.

3. A differential injector for mixing in a flow device according to claim 2, wherein said cavity is dimensioned, configured and arranged to be in fluid communication with the secondary fluid port.

4. A differential injector for mixing in a flow device according to claim 2, wherein said cavity is dimensioned, configured and arranged to be in fluid communication with the secondary fluid port and said plurality of channels.

5. A differential injector for mixing in a flow device according to claim 1, wherein said plurality of channels are disposed within said second wall portion peripheral to said venturi.

6. A differential injector for mixing in a flow device according to claim 1, wherein said substantially cylindrical flow body is made of a composite plastic material.

* * * * *